US005315951A

United States Patent [19]

Finkl

[11] Patent Number: 5,315,951

[45] Date of Patent: May 31, 1994

[54] MEANS FOR IMPROVING THE PERFORMANCE OF PLANING-TYPE BOAT HULLS

[76] Inventor: Anthony W. Finkl, 445 E. Royal Flamingo Dr., Sarasota, Fla. 34236

[21] Appl. No.: 826,717

[22] Filed: Jan. 28, 1992

[51] Int. Cl.[5] ..... B63B 1/28

[52] U.S. Cl. ..... 114/280; 114/286

[58] Field of Search ..... 114/280, 281, 282, 284, 114/285, 286, 126, 145 A, 145 R

[56] References Cited

U.S. PATENT DOCUMENTS

| | | | |
|---|---|---|---|
| 1,779,075 | 10/1930 | Plum . | |
| 2,832,304 | 4/1958 | Elyosius et al. . | |
| 3,053,489 | 9/1962 | Robinson et al. | 440/61 |
| 3,247,820 | 4/1966 | White . | |
| 3,370,561 | 2/1968 | Ilon . | |
| 3,424,120 | 1/1969 | Koriagin | 114/280 |
| 3,477,400 | 11/1969 | Walker . | |
| 3,602,178 | 8/1971 | White . | |
| 3,628,486 | 12/1971 | Bennett . | |
| 4,597,742 | 7/1986 | Finkl | 114/284 |
| 4,951,591 | 8/1990 | Coles | 114/284 |
| 4,967,682 | 11/1990 | O'Donnell . | |

FOREIGN PATENT DOCUMENTS 1139479 2/1957 France .

*Primary Examiner*—Michael S. Huppert
*Assistant Examiner*—Thomas J. Brahan
*Attorney, Agent, or Firm*—Baker & McKenzie

[57] ABSTRACT

An improved hydrofoil system is provided for boats with planing-type hulls Two hydrofoils, one mounted adjacent to each chine, are provided in a submerged position. The attack angle of each hydrofoil is controlled independently by a hydraulic cylinder or the equivalent thereof. Because both positive and negative attack angles of each hydrofoil may be presented, the hydrofoil system disclosed has the ability to raise and lower the bow, raise and lower the stern, provide lateral stability and also act as an auxiliary rudder by rotating the boat about its longitudinal axis. The submerged hydrofoil system is intended for use with boats with planing-type hulls.

1 Claim, 3 Drawing Sheets

MEANS FOR IMPROVING THE PERFORMANCE OF PLANING-TYPE BOAT HULLS

This invention relates generally to devices for controlling the running attitude of planing-type boat hulls and specifically to hydroplanes or hydrofoils that can both raise and lower the bow (and stern) and also provide lateral stability and act as an auxiliary rudder.

BACKGROUND OF THE INVENTION

It is known to use trim planes or hydroplanes, mounted from the transom to lower the bow of boats with planing hulls to reduce the time it takes to achieve the planing condition. However, the ability to control the wetted area of planing hulls has been narrowly limited to the single function of forcing the bow down by the use of transom-mounted trim planes. However, this single function is insufficient for various hull designs and sea conditions. Namely, there is a need for a hydrofoil system that will not only lower the bow, but raise the bow, improve lateral stability and assist in steering the boat as may be required for various hull designs and sea conditions.

An understanding of the contribution made by the present invention requires an understanding of planing boat hulls and previous hydrofoil designs or trim planes for planing hulls. Boats having planing hulls are designed to operate most efficiently at speeds where the hull "planes" on top of the surface of the water and a minimum area of the hull is in contact with the surface of the water. Typically, about one-half to two-thirds of the hull surface area is wetted at planing speeds. However, the extent of the wetted area may vary. With hulls having a transom deadrise, or an upward angle from the keel to the chine, of 10 degrees or more, less than one-half of the hull area may be wetted at planing speeds. Depending upon the hull design, as little as one-fourth of the hull area may be wetted during high speed operation.

When a boat accelerates, the natural tendency of the boat is to push the stern down and raise the bow. This stern-down, bow-up position is an inefficient use of engine power and fuel. Because the planing condition of the hull increases both speed and fuel efficiency, the primary goal of most hydrofoil or trim planes designs is to force the bow down to a horizontal angle thereby promoting planing of the hull and reducing the time for the boat to achieve the planing condition. Unfortunately, the existing designs perform this function only and do not address other performance and handling problems that arise.

For example, when the sea conditions are quite rough, it is desirable to raise the bow thereby causing the face of the waves to hit the boat hull rather than the tip of the bow causing the boat to take on water. Further, as stated above, many planing-type boat hulls employ a transom deadrise When the transom deadrise, or angle from the keel to the chines, is 10 degrees or more, the boat is less stable because the hull is not flat, but is V-shaped. Therefore, extra stability it desirable, especially during rough sea or water conditions Previous hydrofoil designs do not address this lateral stability problem.

Further, prior hydrofoil designs fail to acknowledge that dual hydrofoils can act as a quasi-rudder and assist in the steering and control of the boat. This additional function of the hydrofoils is desirable for rough handling boats and would be essential if the rudder system broke or because dysfunctional.

Thus, there is a need for transom-mounted hydrofoils that not only act to lower the bow, but also act to raise the bow and provide lateral stability and directional control. Hence, the opportunity to add additional safety and handling features to a boat with a planing-type hull should not be foregone as it is when current hydrofoil or trim systems are employed.

SUMMARY OF THE INVENTION

An improved hydrofoil system for planing-type boat hulls is provided. The hydrofoil system includes two hydrofoils, each hydrofoil mounted on opposing sides of the transom, near each chine. Each hydrofoil includes a foot, a control leg and a means for adjusting the attack angle of the foot. Each hydrofoil is mounted on opposing sides of the transom of the boat near a chine.

The foot is fixably attached to the control leg, normally by welding, and is disposed below the chine. The control leg is pivotally attached to the mounting brackets and also provides an anchor means for accommodating one end of the attack angle adjustment mechanism. The attack angle adjustment mechanism provides a mechanically non-complicated way to adjust the attack angle of the foot.

In the preferred embodiment, the attack angle adjustment means is a longitudinally adjustable arm with two ends. One end is mounted to the transom; the other end is mounted to the anchor means on the control leg. The preferred embodiment features a manually controlled motorized mechanism for independently expanding and contracting the length of each longitudinally adjustable arm. Manual fingertip controls are provided for controlling the length of each control arm and therefore the attack angle of each foot.

The submerged hydrofoils of the present invention perform more than the single function of lowering the bow for planing. As stated below, the objects of the hydrofoils of the present invention include the ability to lower the bow, but also include the ability to raise the bow, improve lateral stability and provide supplemental directional control.

It is therefore an object of the present invention to provide a submerged hydrofoil system that reduces the time it takes for a boat to achieve the planing condition.

It is also an object of the present invention to provide a submerged hydrofoil system that lowers planing speeds.

It is also an object of the present invention to provide a submerged hydrofoil system that will compensate for excessive bow or stern weight.

Other objects of the present invention include providing submerged hydrofoils that improve directional control, improving lateral stability, eliminating stern lift from surface drives or stern lift from conventional inboard drive systems, reduction of turning radius and improvement of top speed under most operating conditions.

BRIEF DESCRIPTION OF THE DRAWINGS

This invention is illustrated more or less diagrammatically in the accompanying drawings wherein.

DETAILED DESCRIPTION OF THE INVENTION

Figure 1:
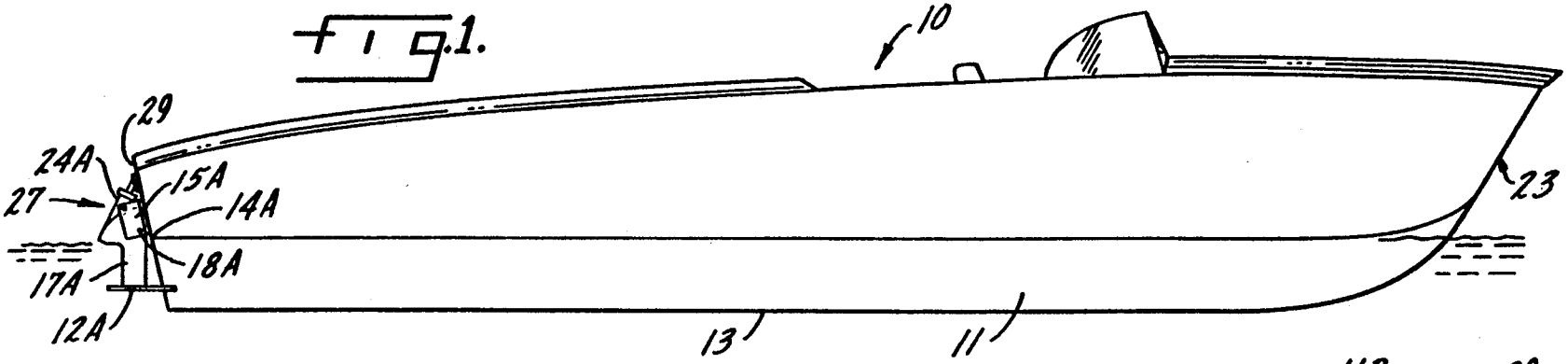
FIG. 1 is a starboard side view of a boat equipped with the hydrofoils made in accordance with this invention.
Figure 2:
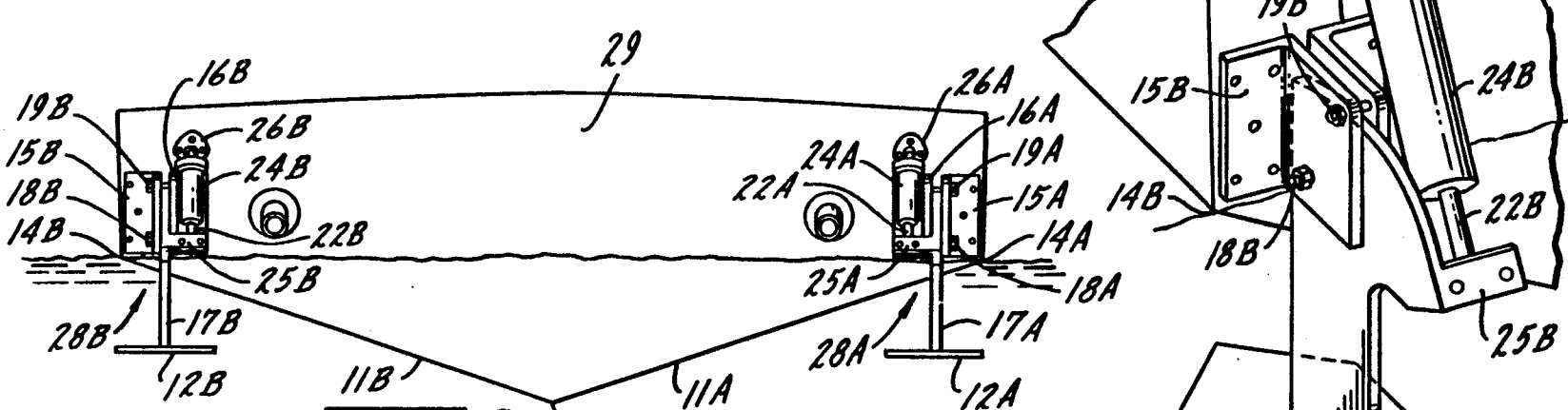
FIG. 2 is the stern of the boat pictured in FIG. 1.
Figure 3:
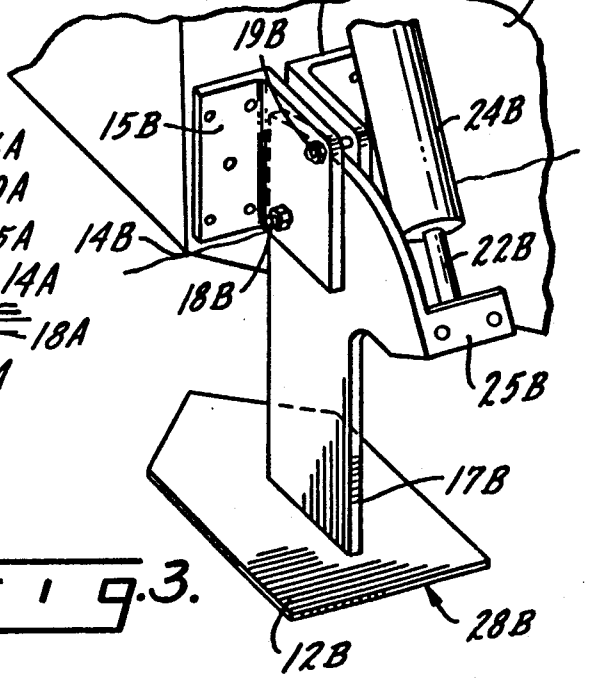
FIG. 3 is an expanded view of the hydrofoil attached to the transom adjacent to the port chine shown in FIG. 2.

Like reference numerals will be used to refer to like or similar parts from figure to figure in the following description of the drawings. For simplicity, in the drawings, elements appearing on the starboard side of the boat 10 shown in FIGS. 1–3 are designated with a number followed by the letter "A". Elements appearing on the port side of the boat 10 shown in FIG. 1–3 are designated with a number followed by the letter "B". When an element is discussed in functional terms without regard to its placement on the port or starboard sides, it will be designated with a number only.

FIG. 1 is a starboard side view of an inboard motorboat 10 with a planing-type hull 11 that is also equipped with the hydrofoil system disclosed by the present invention. The boat 10 includes a planing hull 11. The hull 11 includes a substantial transom deadrise, as best seen in FIG. 2. In the preferred embodiment depicted in FIGS. 1–3, when the hull 11 includes a substantial transom deadrise, the foot 12 of the hydrofoil system 28 is vertically disposed above the keel 13 but below its respective chine 14.

The relative location of the hydrofoils is best seen in FIG. 2. Two mounting angle plates 15, 16 are attached in parallel relationship to each other near the respective chine 14. The control leg 17 fits between the mounting angle plates 15, 16 and is pivotally attached to the mounting angle plates 15, 16 by a pivot bolt 18 (see FIG. 3). A friction adjustment bolt 19 controls the lateral clearance of the control leg 17.

The means for adjusting the attack angle of the foot 12 is best understood upon examination of FIG. 3 As seen in FIG. 3, the foot 12 is in an approximate horizontal position or zero attack angle. In this position, the foot 12 is merely providing lateral stability to the boat 10 and is not providing an upward or downward force on the bow 23. An extensible and retractable arm for adjusting the angle of attack is indicated at 22, the arm 22 being an extension of the piston rod of the hydraulic cylinder 24. The hydraulic cylinder 24 is controlled manually by the pilot of the boat 10. Preferably, an electric control is available to the pilot which activates a motor which thereby controls the extension of the adjustable arm 22 and hence the angle of attack of the foot 12.

Figure 4:
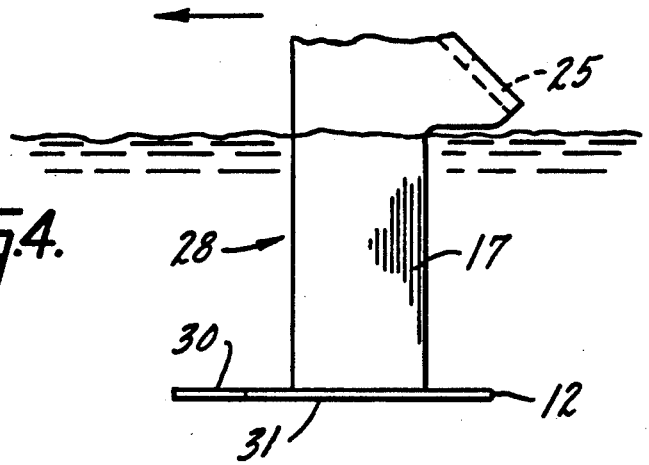
FIG. 4 is a side view of a hydrofoil made in accordance with this invention in its neutral position.
Figure 5:
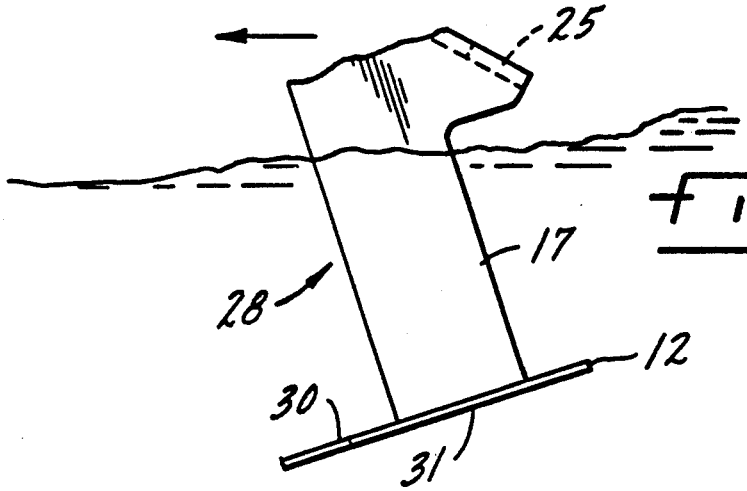
FIG. 5 is a side view of a hydrofoil made in accordance with this invention in the negative attack position to raise the bow and lower the stern.
Figure 6:
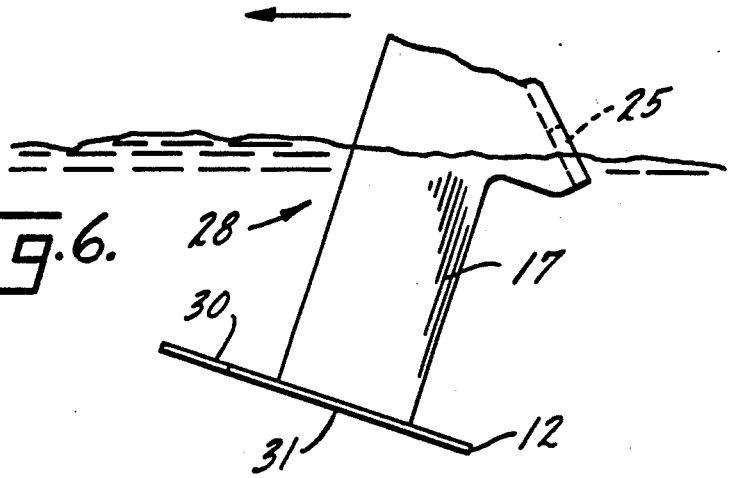
FIG. 6 is a side view of a hydrofoil made in accordance with this invention in a positive attack angle position to lower the bow and raise the stern.

As shown in FIG. 2, the lower end of the arm 22 is attached to the anchor flange 25 of the control leg 17 and to the lower end of the hydraulic cylinder 24. The upper end of the control arm 22 is mounted directly to the transom 29 at the mounting bracket 26 and to the upper end of the hydraulic cylinder 24. The two hydraulic cylinders 24A, 24B may be uniformly controlled by the pilot or independently controlled by the pilot depending on the effects required FIGS. 4–6 illustrate the three primary positions of any one hydrofoil during operation. FIG. 4 illustrates the hydrofoil 28 in the zero attack position; the foot 12 is at an attack angle substantially parallel to the direction of the boat and the surface of the water. The water flows around the foot 12 and around the control leg 17 without substantial drag caused by either element. In various tests to determine the effect of underwater drag caused by the hydrofoils 28, no loss of boat speed nor loss of motor rpms could be detected in hulls 11 ranging from 20 to 27 feet long with speeds of up to 55 mph when the feet 12 were operating at zero degrees of attack or the neutral angle shown in FIG. 4.

FIG. 5 shows the control leg 17 and foot 12 in the negative attack angle position which brings down the stern 27 and raises the bow 23 of the boat 10. In contrast, FIG. 6 shows the control leg 17 and foot 12 in a positive attack angle position which raises the stern 27 and brings down the bow 23 of the boat 10. If the pilot wishes to raise the bow 23 when encountering rough sea conditions, the pilot adjusts both hydrofoils 28A, 28B to a position similar to that shown in FIG. 5. If the pilot wishes to lower the bow 23 in order to reduce the time to achieve planing, the pilot adjusts both hydrofoils 28A, 28B to a position similar to that shown in FIG. 6.

Figure 7:
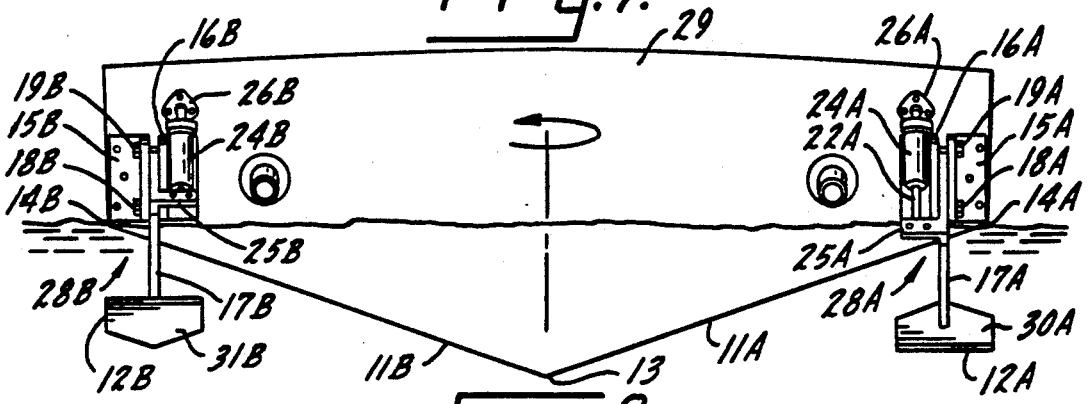
FIG. 7 is the boat shown in FIG. 2, the hydrofoils being in a position to steer the boat in a port direction.
Figure 8:
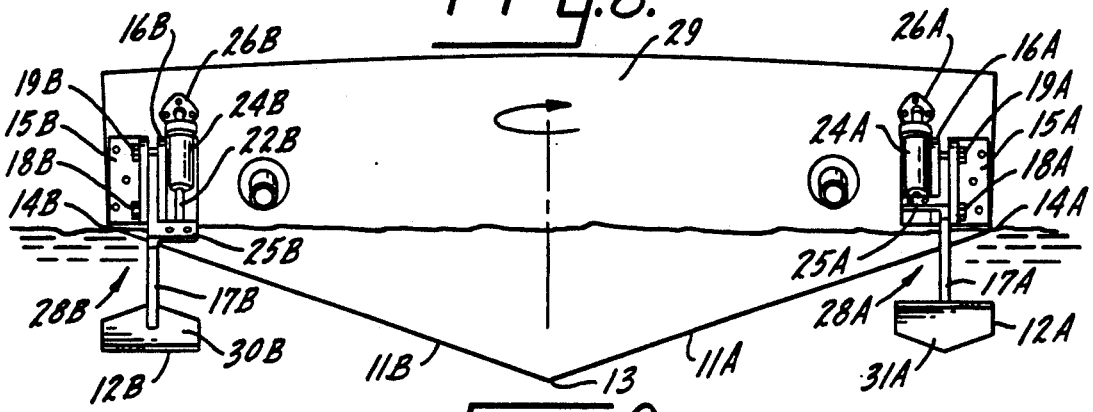
FIG. 8 is the boat shown in FIG. 2, the hydrofoils being in a position to steer the boat in a starboard direction.

FIGS. 7 and 8 illustrate the auxiliary or emergency steering capability of this invention that may be employed in the event the rudder or primary steering mechanism fails. In FIG. 7, the boat 10 will turn in the port direction because foot 12B is in the negative attack angle position and foot 12A is in the positive attack angle position. The foot 12B acts as a brake along the port side and the foot 12A provides a lifting force along the starboard side thereby causing the boat 10 to pivot to the port direction. Similarly, in FIG. 8, the boat 10 will turn to the starboard side because foot 12A is in the negative attack angle position and foot 12B is in the positive attack angle position. The boat 10 will pivot toward the starboard side due to the braking action the foot 12A and the lifting action of the foot 12B.

Figure 9:
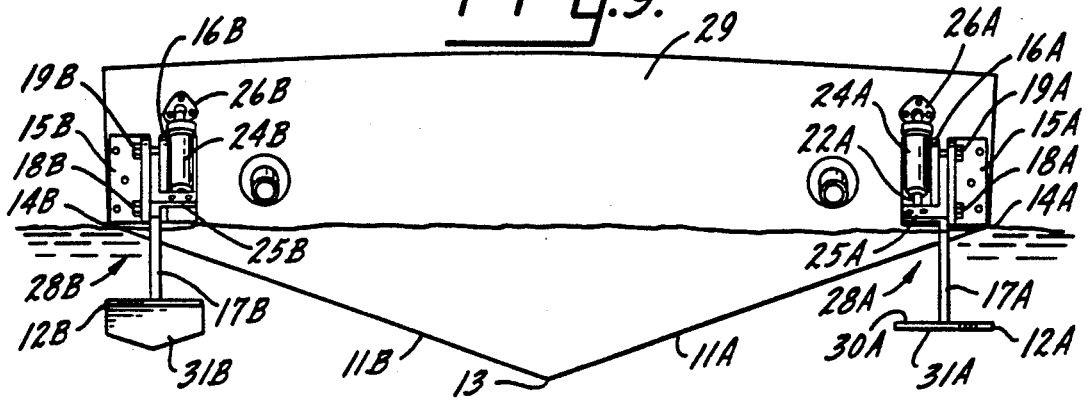
FIG. 9 is the boat shown in FIG. 2, the hydrofoils being in a position to counteract a roll to the starboard side.

FIG. 9 shows the two hydrofoils 28A, 28B in a position to counteract a roll or a running list to the starboard side. The starboard hydrofoil 28A is in a neutral position and the port hydrofoil 28B is in a negative attack angle position. The hydrofoil 28B is acting to bring down the port side of the boat 10 to counteract a downward force on the starboard side of the boat 10.

Figure 10:
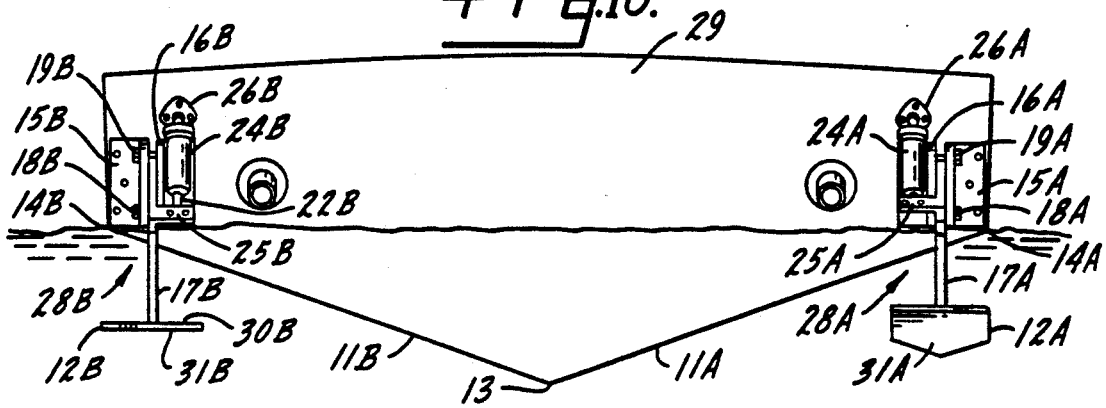
FIG. 10 is the boat shown in FIG. 2, the hydrofoils being in a position to counteract a roll to the port side.

Conversely, in FIG. 10, the hydrofoils 28A, 28B are in a position to counteract a roll or a running list to the port side. The port hydrofoil 28B is in a neutral position and the starboard hydrofoil 28A is in a negative attack angle position thereby providing a downward force to the starboard side of the boat 10. The result of the positions shown in FIG. 10 is to counteract a roll to the left or the port side of the boat 10.

Thus, the present invention provides the pilot with the ability to (a) both raise and lower the bow 23 of the boat 10, (b) stabilize the boat 10 and (c) steer the boat 10. This ability may be provided at the pilot's fingertips because conventional electric motors may be used to activate and adjust the hydraulic cylinders 24A, 24B and the adjustable arms 22A, 22B independently. The present invention can provide all these functions because both hydrofoils 28A, 28B are submerged thereby employing both the top 30 and bottom 31 surfaces of the hydrofoils. As shown in FIGS. 9 and 10, the hydrofoils 28A, 28B provide additional safety and lateral stability when employed with hulls having a transom deadrise For safety reasons, the combined effective area of the bottoms 31A, 31B is not large enough to generate enough force to lift the stern 27 above the running surface of the water.

Because the hydrofoils 28A, 28B of the present invention reduce the time to achieve planing, the hydrofoils 28A, 28B contribute to fuel efficiency of the boat 10. Further, because the hydrofoils present very little forward surface area when in the zero attack position (see FIG. 4), the hydrofoils 28A, 28B do not significantly affect the underwater drag of the boat 10. The hydrofoils 28A, 28B may also compensate for excessive bow weight or stern weight When both hydrofoils 28A, 28B are in a positive attack angle position as shown in FIG. 6, the upward forces provided by water engaging the bottoms 31A, 31B of the feet 12A, 12B compensate for excessive stern weight When both hydrofoils 28A, 28B are in a negative attack angle position, see FIG. 5, the downward forces provided by water engaging the tops 30A, 30B of the feet 12A, 12B compensate for excessive bow weight. As shown in FIG. 1, the bottom 31A, 31B of both hydrofoils 12A, 12B are located above the keel line 13 thereby preventing damage from grounding or other submerged hazards Finally, the installation and removal of the hydrofoils 28A, 28B is relatively fast and simple. Installation takes less than three hours and removal less than one-half hour.

Although the preferred embodiment of the present invention has been illustrated and described, it will once be apparent to those skilled in the art that variations may be made within the spirit and scope of the invention. Accordingly, it is intended that the scope of the invention be limited solely by the scope of the hereafter appended claims and not by the specific wording in the foregoing description.

I claim:

1. A hydrofoil system with an adjustable angle of attack for a boat with a planing-type hull, the boat further including a transom, a keel and two chines disposed at opposing sides of the transom, the hydrofoil system comprising:

two hydrofoils, each hydrofoil mounted on an opposing side of the transom, near each chine, each hydrofoil including a foot, a control leg, each control leg being disposed between two mounting brackets, and an attack angle adjustment means, the foot having a surface area, the foot being fixable and perpendicularly attached to a bottom edge of the control leg, the bottom edge of the control leg being attached to a middle portion of the foot so that substantially one-half of the surface area of the foot is disposed to a right side of the control leg and substantially one-half of the surface area of the foot is disposed to a left side of the control log, the foot being located below each chine, the control leg and the bottom edge of the control leg being disposed in a vertical plane that is substantially parallel with the keel of the hull, an upper end of the control leg being pivotally attached between the mounting brackets by a pivot bolt, the control leg pivoting about an axis at a substantially right angle to the keel of the hull, the control leg further including an anchor means for accommodating one end of the attack angle adjustment means, the anchor means being disposed on an inboard side of the control leg, the mounting brackets being fixably attached to the transom, the mounting brackets attached to each other by a friction bolt and the pivot bolt, the attack angle adjustment means providing adjustment of the angle of attack of the foot, the attack angle adjustment means including a longitudinally adjustable arm with two ends, one end mounted to the transom, the other end mounted to the anchor means of the control leg, the attack angle adjustment means further including a means for mutually controlling the length of the longitudinally adjustable arm, the attack angle adjustment means further being disposed inboard of the control leg and mounting brackets, each attack, angle adjustment means providing both negative attack angles of the foot and positive attack angles of the foot.

* * * * *